United States Patent [19]

Neidigh et al.

[11] 4,199,905

[45] Apr. 29, 1980

[54] BLAST HEAD RIGGING APPARATUS FOR TANK SIDE CLEANING

[75] Inventors: Robert J. Neidigh, Breman; Harvey G. Van Fossen, Mishawaka, both of Ind.

[73] Assignee: Wheelabrator-Frye Inc., Hampton, N.H.

[21] Appl. No.: 940,958

[22] Filed: Sep. 11, 1978

[51] Int. Cl.[2] ..... B24C 1/00; B24C 3/06

[52] U.S. Cl. ..... 51/429; 51/180; 180/901

[58] Field of Search ..... 15/337 R, 340; 51/180, 51/319-321, 429; 114/222; 118/305; 180/1 VS; 182/36-38, 142, 150; 187/11; 248/662, 669

[56] References Cited

U.S. PATENT DOCUMENTS

| | | | |
|---|---|---|---|
| 2,098,262 | 11/1937 | Temple | 114/222 |
| 2,543,348 | 2/1951 | Briese | 182/36 X |
| 3,114,433 | 12/1963 | Downs | 182/142 X |
| 3,820,633 | 6/1974 | Thorp | 180/1 VS |
| 3,837,429 | 9/1974 | Harris | 182/142 X |
| 3,863,393 | 2/1975 | Goff | 51/429 |
| 3,900,080 | 8/1975 | Rea | 182/36 |
| 3,900,968 | 8/1975 | Shigyo | 51/5 A |
| 3,984,944 | 10/1976 | Maasberg | 51/429 X |

*Primary Examiner*—Gary L. Smith

*Attorney, Agent, or Firm*—McDougall, Hersh & Scott

[57] ABSTRACT

A portable blast head rigging apparatus is disclosed which is particularly suited for use in cleaning the sides of large storage tanks. The rigging employs a travel car having a winch mechanism thereon. By means of a cable connected to the top of the tank the car crawls up the side of the tank to the top where it is pivoted into a position from which it can travel around the entire circumference of the tank. Once in place the travel car hoists a rigging into position against the tank side suspended from the travel car. The blast head is then moved up and down within the rigging by operation of the travel car winch mechanism and the travel car is repositioned periodically to permit treatment of the entire tank.

11 Claims, 6 Drawing Figures

BLAST HEAD RIGGING APPARATUS FOR TANK SIDE CLEANING

BACKGROUND OF THE INVENTION

This invention relates to the field of blast cleaning equipment. More specifically, it relates to rigging utilized for positioning blast cleaning equipment against the sides of large storage tanks. Such tanks require periodic cleaning in order to remove scale, rust and other debris prior to painting or other surface treatment. This is usually accomplished by means of blast cleaning the surface with suitable abrasives by means of a centrifugal throwing wheel device. Such devices are well known in the art and, for example, may be of the type manufactured by Wheelabrator-Frye Inc. of Mishawaka, Ind.

In order to treat substantially the entire surface of the tank, it is necessary to move the blast device over the circumference of the tank in a uniform manner. For that purpose a number of rigging or suspension schemes have been developed. These include the use of large cranes which are erected and then used to suspend the blast head against the tank sides, or the erection of a scaffolding on the top of the tank to which a rigging or trolley may be attached. In the latter case a crane is also necessary for placing and removing the rigging and for attaching the blast means. Other prior art arrangements are described in the prior art statement of this specification.

In order to lower the cost of blast treating tank sides, it is desirable to provide a blast rigging device which does not require special scaffolding to be installed on the tank nor the use of a crane to erect the rigging. Stated differently, it is desirable to develop a rigging which can "bootstrap" itself up the tank and then lift the rigging in place and subsequently serve to move the rigging and blast head over the surface of the tank. That objective and others are accomplished by the present invention.

SUMMARY OF THE INVENTION

The present invention employs a travel car unit capable of hoisting itself up the side of a tank to a position wherein one set of wheels are on the top of the tank with the remaining set of wheels on the side of the tank. Thus positioned, it is secured to the top of the tank by cables for rotation around the tank. A winch mechanism on the travel car is utilized to lift the rigging and to secure it to the travel car. Finally, the blast head is raised and lowered within the rigging by the winch mechanism during the course of treatment. After a vertical section of the tank has been treated the travel car moves to a new section where the process repeats.

OBJECTS OF THE INVENTION

It is, accordingly, an object of the invention to provide a simplified and low cost blast head rigging for use in conjunction with cleaning the sides of large storage tanks.

It is a further object of the invention to provide a blast head rigging which does not require the use of cranes or specially installed scaffolding to accommodate the rigging during cleaning.

A further object of the invention is to provide a travel car mechanism capable of climbing the side of a tank and positioning itself at the top thereof for rotation about the tank and capable of moving a blast head rigging thereon for movement therewith.

Another object of the invention is the provision of a self-erecting blast head rigging which is portable and rapidly installed and removed.

Other objects and advantages of the invention will be apparent from the remaining portion of the specification.

PRIOR ART STATEMENT

In accordance with the provisions of 37 CFR Sec. 1.97, applicants acknowledge the following references as the closest prior art of which they are aware: U.S. Pat. Nos. 3,900,968 to Shigyo; 3,984,944 to Maasberg et al; and 2,098,262 to Temple; the invention described in U.S. patent application Ser. No. 794,728, filed May 9, 1977, now abandoned, assigned to the present assignee.

The Shigyo patent discloses a blast cleaning device for the treatment of vertical surfaces in which a crane maintains the treating device against the surface (FIG. 1) or, alternatively, a trolley car E is suspended on rails attached to the top of the surface (FIG. 2). Maasberg et al teach a cleaning device suspended from a lifting mechanism 2 movable on a rail 14 (FIG. 1). The mechanism includes a winch 10. The Temple reference discloses a cleaning device secured by a trolley mechanism 42 in which an offset center of gravity is employed to maintain the device against the surface. Finally, the invention disclosed in the referenced patent application employs a trolley arrangement with an offset center of gravity to maintain a rigging, having a blast head mounted thereon, against a vertical surface.

DETAILED DESCRIPTION

Figure 1:
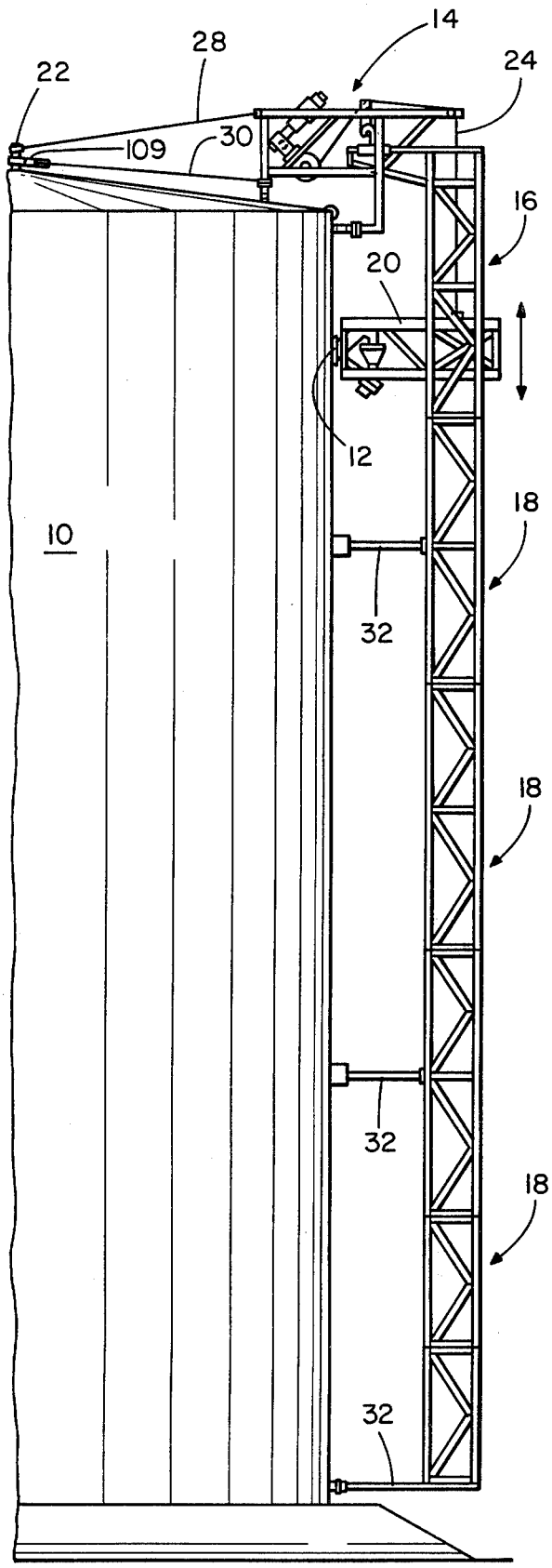
FIGS. 1 and 2 are side elevational views of a storage tank showing the rigging apparatus according to the invention in various stages of assembly.
Figure 2:
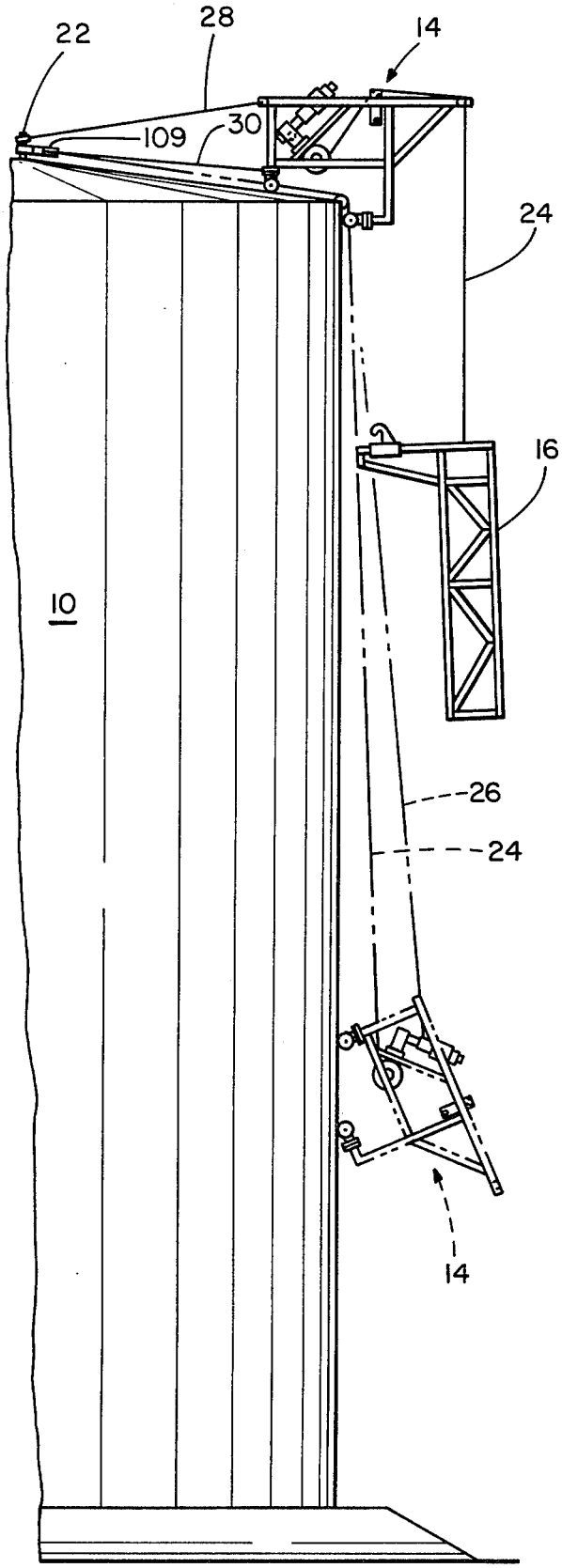

Referring now to FIGS. 1 and 2, the invention is illustrated in conjunction with a large storage tank. The tank 10 requires periodic surface treatment for the purpose of preventing rust, etc. The treatment is effected by use of centrifugal blast wheels of the type referenced in the background portion of the specification. The present invention relates to a rigging apparatus which is transported to the tank and once in position is effective for moving the blast head 12 up and down over the entire surface of the tank. The principal elements of the invention are a travel car indicated generally at 14, rigging sections 16 and 18 and a blast head frame 20.

As indicated schematically in FIG. 2, the travel car is a wheeled frame including a winch to be described in connection with FIG. 3. The travel car is attached to a center post 22 at the top of the tank by one or more cables 24 and 26. The travel car winch mechanism is then utilized to pull the travel car up the side of the tank until it reaches the position shown in solid lines in FIGS. 1 and 2. It is then secured to the tank center post 22 by cables 28 and 30. The winch cable is next utilized for raising the top rigging section 16 onto a rigging hook carried by the travel car. As the rigging is raised off the ground, extension sections 18 are secured thereto until the entire rigging illustrated in FIG. 1 is assembled and positioned as shown. Standoffs 32 may be utilized at appropriate distances to properly position the rigging.

Figure 5:
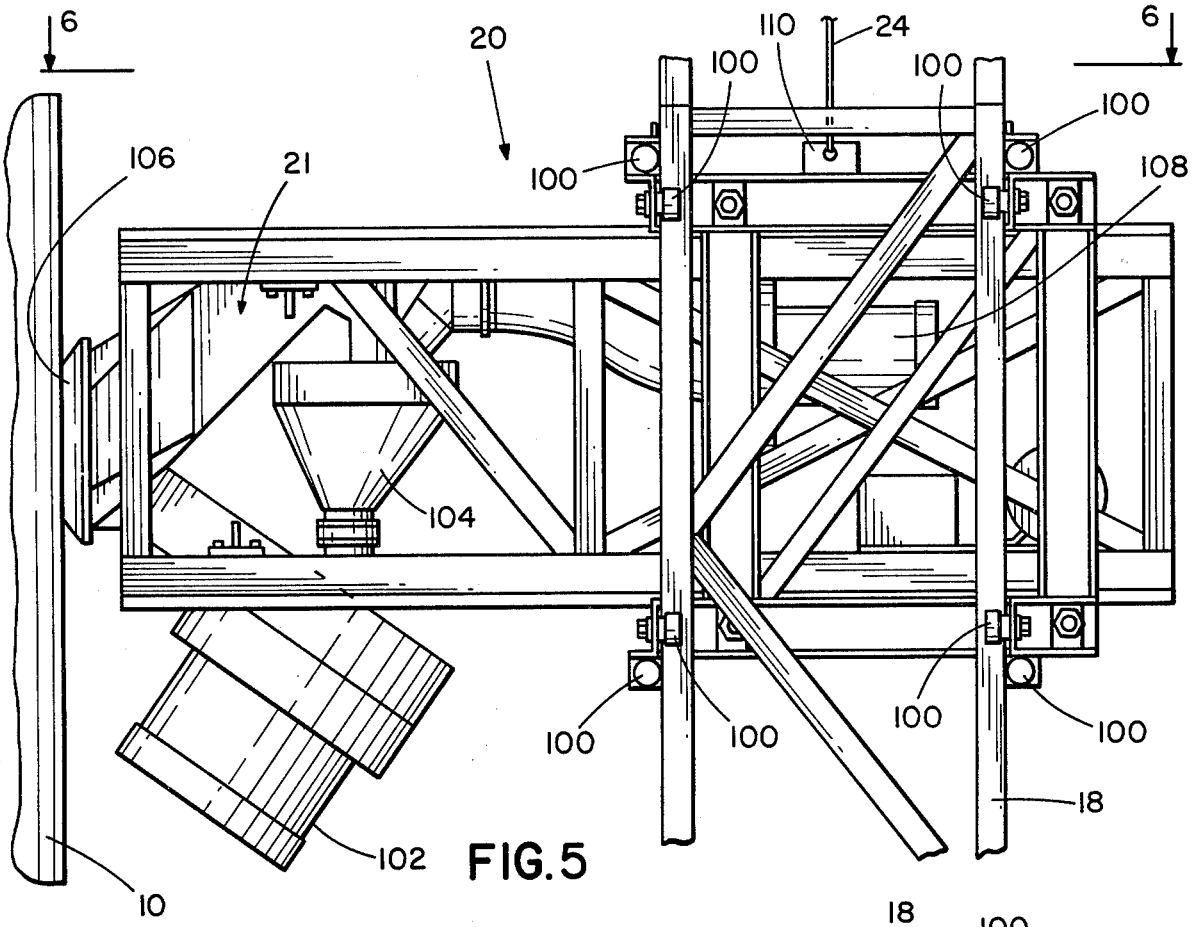
FIG. 5 is a side elevational view of the blast head carriage.
Figure 6:
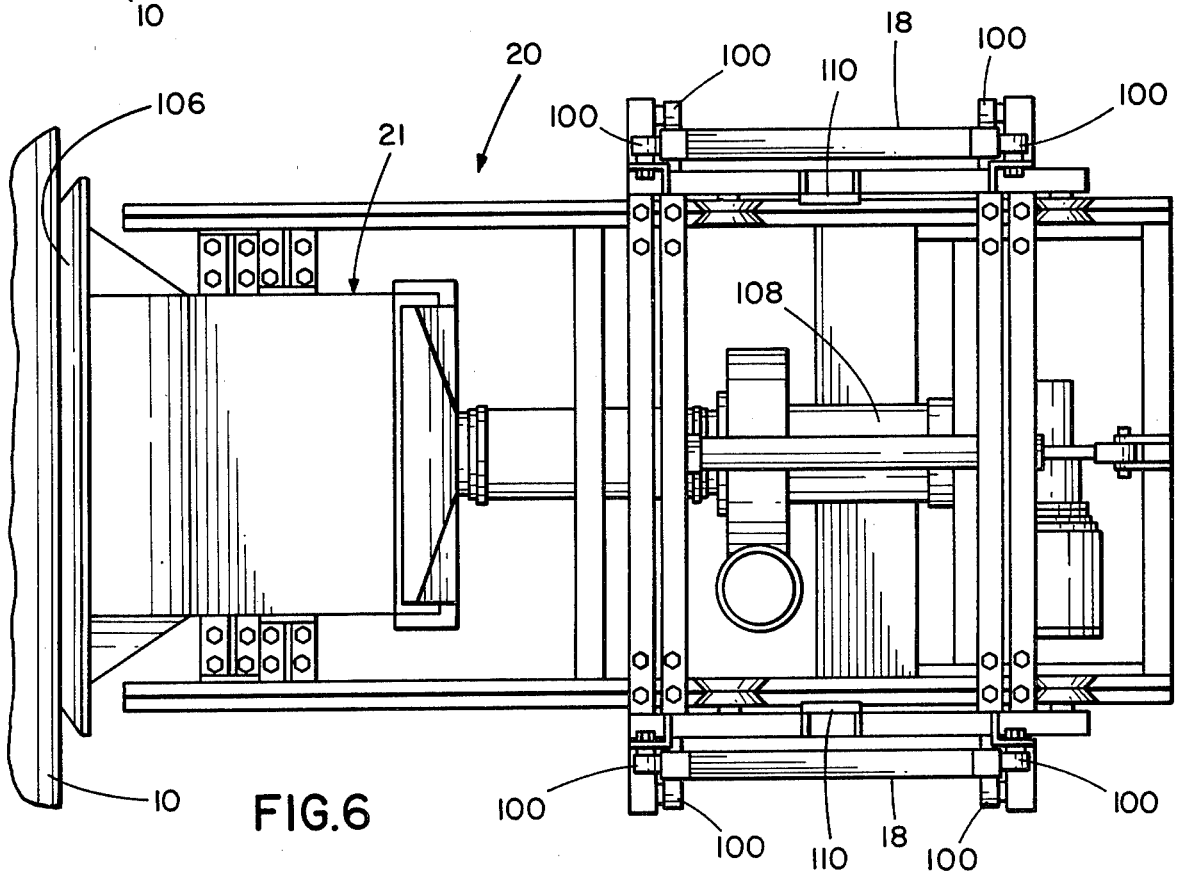
FIG. 6 is a plan view of a blast head carriage along the lines 6—6 of FIG. 5.

As illustrated in conjunction with FIGS. 5 and 6, the blast head frame 20 is arranged to move up and down on the rigging under control of the travel car winch. The frame carries the blast head 21 and thus movement of the frame is effective for moving the blast head over the tank surface.

As will be appreciated, this general arrangement completely avoids the necessity of utilizing a crane or a fixed scaffold mounted to the tank to accomplish blast treatment.

Figure 3:
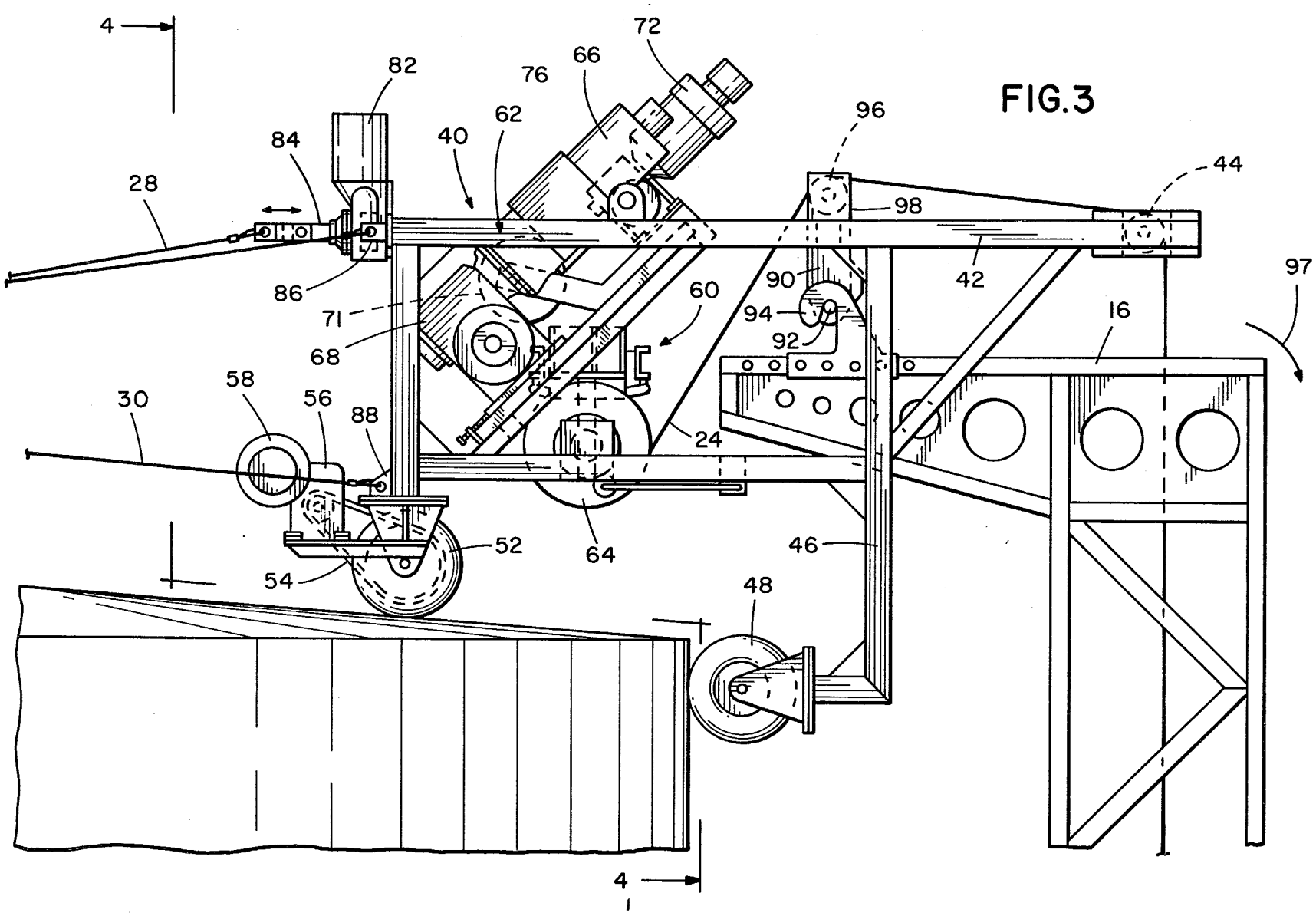
FIG. 3 is an enlarged side elevational view of the invention in position on a tank.
Figure 4:
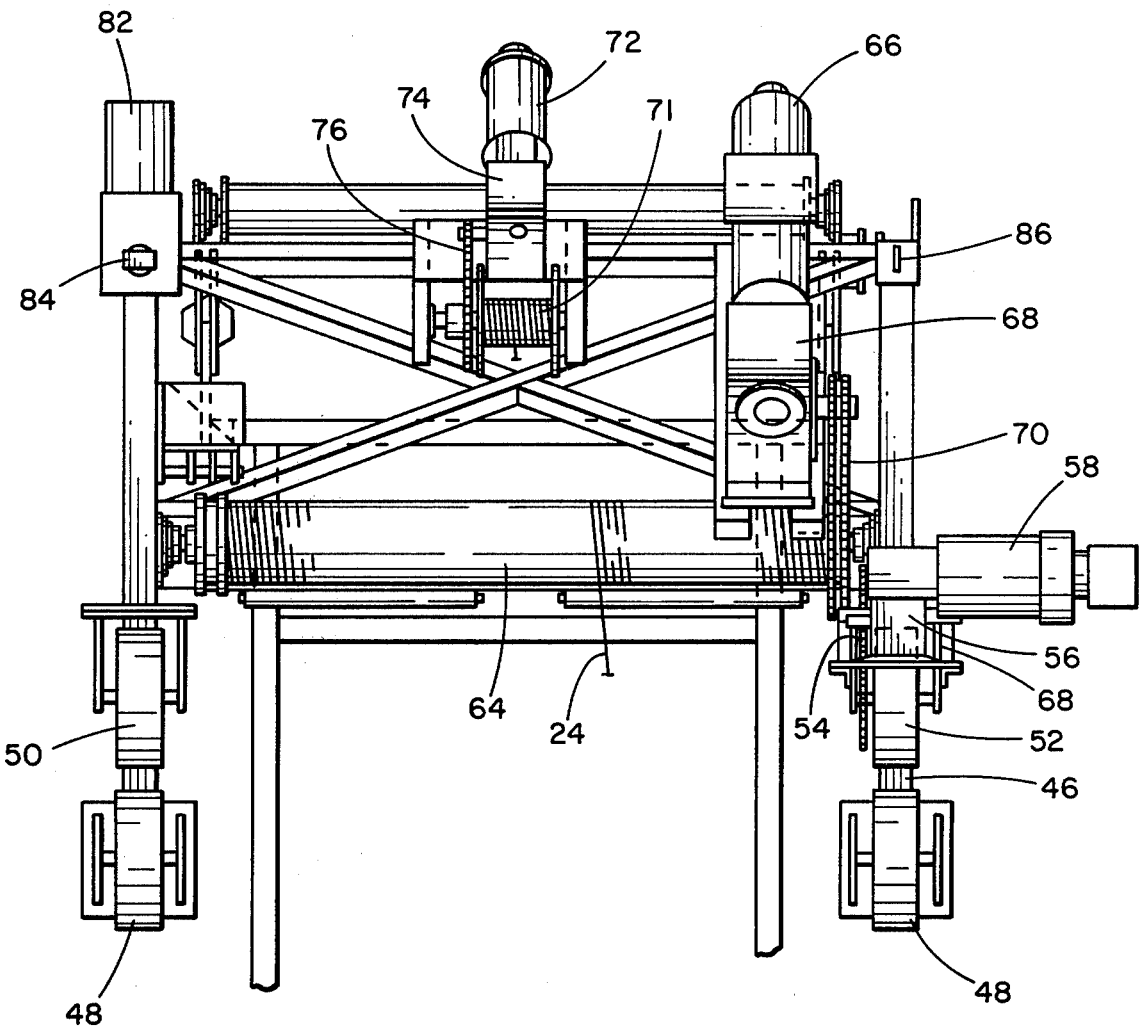
FIG. 4 is a front elevational view along the lines 4—4 of FIG. 3.

Referring now to FIGS. 3 and 4, the construction details of the travel car are illustrated. The travel car frame 40 is generally rectangular and includes at the rear end thereof cantilevered members 42 having a cable roller 44 supported therebetween. Extending downwardly from the rectangular frame are a pair of legs 46 having a wheel 48 rotatably mounted thereto at a right angle to the legs. Extending downwardly from the front portion of the frame are a pair of wheels 50 and 52. Wheel 52 is motor driven via a belt 54, gear box 56 and motor 58. When the travel car is in the position illustrated in FIG. 3, the wheel 52 is rotated 90° to the position shown in FIG. 1. The motor 58 then drives the travel car assembly around the periphery of the tank repositioning the rigging, as necessary, to reach succeeding vertical strips of the tank.

Secured to the rectangular frame are a pair of winch mechanisms indicated generally at 60 and 62. The main winch 60 includes a roll 64 driven by a motor 66 through a gear box 68 and chains 70. The auxiliary winch 62 includes a roll 71 driven by a motor 72 through a gear box 74 and chains 76.

As best seen in FIG. 3, the front end of the frame is provided with a tensioning mechanism including a motor 82 which drives a threaded element 84 to which one end of the support cable 28 is connected. The support cable 28 passes from the element 84 to the tank center post 22 and then back to the travel car where it is secured to an eyelet 86. Operation of the motor 82 is effective for moving the threaded element 84 to the left or right, as viewed in FIG. 3, to maintain tension on the cable to correctly position the travel car on the top of the tank. A second cable 30 is employed for connecting the travel car with the center post. This cable operates as a safety in the event of a break in the main cable 28. It is secured to an eyelet 88 located at the bottom of the frame.

The rear portion of the travel car is provided with a hook plate 90 having a pin 92 thereon to which the upper section of the rigging 16 is attached. For that purpose the rigging includes a hook 94 suitably dimensioned to receive the pin 92 therein. The hook 94 is located offcenter with respect to the centroid of the rigging 16 to create a rotational force centered about the pin 92 in the direction indicated by the arrow 97. As viewed in FIG. 1, this force tends to maintain the rigging firmly against the side of the tank.

In addition to the cable roller 44 a second cable roller 96 is provided between a pair of upstanding flanges 98 secured to the upper portion of the travel car frame. As indicated in FIG. 3, the cable 24 comes off the main winch roll 64 from the underside thereof and passes over both cable rollers 96 and 44 before travelling downwardly to a point of attachment with the blast head frame 20.

The various motors on the travel car are manually operated by an operator positioned at the bottom of the tank. Remote controls, well known in the motor art, may be employed as desired for that purpose.

Referring to FIGS. 5 and 6, the blast head frame 20 and the blast head 12 are illustrated in greater detail. The frame 20 is provided with four or more wheels 100 extending outwardly from the frame beyond the sides of the rigging 18. The wheels engage the outside of the rigging and travel thereon as the frame moves vertically on the rigging. The blasting device 21, of conventional design, includes a housing 102 having a motor and throwing wheel therein, a supply hopper 104, a flexible seal 106 which engages the surface of the tank 10 to prevent the escape of blast particulate. The blast wheel assembly is secured to the frame 20 in a conventional manner except that a cylinder 108 is employed to permit retraction of the blast head from the tank surface, if necessary, to clear obstructions.

The assembly and operation of the invention thus far described is as follows. Initially, an operator climbs to the top of the tank and connects cables 24 and 26 (FIG. 2) to the tank center post 22. A second operator on the ground initiates operation of the main and auxiliary winches 60 and 62 causing the travel car 14 to begin climbing the side of the tank. The cable 24 carries most of the weight of the travel car with cable 26 serving to stabilize the car during the climb and permitting changes in the angular orientation if necessary.

Upon reaching the top of the tank the travel car pivots to the position indicated in solid lines in FIG. 2 with the rear wheels 48 engaging the side of the tank and the front wheels supporting the travel car on the tank top. At that point the winches are shut down and cables 28 and 30 are attached between the travel car and the tank center post using a snatch block 109 or similar rotatable connector. The tension in cable 28 is adjusted by means of the screw mechanism 84 to correctly position the travel car relative to the edge of the tank. The cables 24 and 26 are then released from the center post with the auxiliary cable 26 being stored on the drum.

The main cable 24 is passed over the cable rollers 96 and 44 as illustrated in FIG. 3 and fed downwardly to an operator on the ground. The operator secures cable 24 to the top section of the rigging 16 and lifts the rigging upwardly as illustrated in FIG. 2. As the rigging is raised additional sections of rigging may be bolted on so that when the top section is in position the entire rigging has been assembled and correctly positioned against the tank. Alternatively, it is possible to pull the rigging up with the travel car in which case the main hoist is used for lifting the travel car and the rigging. This latter operating mode is less desirable because of the inability to orient the travel car during movement up the side of the tank.

When the top section of rigging reaches the travel car the hook 94 engages pin 92 securing the rigging to the hook plate 90 and, in turn, to the travel car. The cable 24 is then disengaged from the rigging and passed downwardly to the ground where the blast head frame 20 is secured thereto by means of connecting plate 110 (FIG. 5). The blast head is then moved vertically in the rigging by operation of the main winch raising and lowering the frame 20. As the blast head moves over the surface of the tank it treats the surface by subjecting it to an abrasive blast in a manner well known in the art.

In order to permit cleaning of the entire tank side the operator repositions the drive wheel 52 so that it is substantially parallel with the circumference of the tank top. After each vertical section of the tank side has been cleaned the operator actuates the wheel drive motor 58 causing circumferential movement of the travel car on the tank top. The rigging attached thereto is, of course, also moved to a new vertical section of the tank where the treatment process continues.

Upon completing the tank cleaning operation the structure is disassembled in essentially the same manner in which it was assembled. First, the blast head and frame are lowered and freed from the rigging. Next the rigging sections are disassembled and lowered by use of the main winch. Finally, the travel car lowers itself to the ground after which the cables 24 and 26 are removed from the tank center post. The apparatus thus described is then ready for transportation to another location for additional use.

While we have shown and described embodiments of this invention in some detail, it will be understood that this description and illustrations are offered merely by way of example, and that the invention is to be limited in scope only by the appended claims.

We claim:

1. A rigging apparatus for use in treating the side of a storage tank with a blasting device comprising:

(a) a wheeled travel car including winch means connectable to the top of said tank for pulling said travel car up the side of the tank and positioning the car on the top along the outer periphery thereof, (b) drive means for selectably moving the car along the tank top periphery, (c) a rigging suspended from said travel car in a position adjacent said tank side, (d) frame means vertically displaceable on said rigging for securing said blasting device in contact with said tank side, said frame means being suspended from said winch means, the latter controlling the vertical movement of the former relative to said rigging.

2. The apparatus according to claim 1 wherein said travel car includes two sets of wheels, one set travelling on the tank top, the other set travelling on the tank side during movement of said car along the top periphery of the tank, whereby correct positioning of the car and the rigging suspended therefrom is maintained during operation of the apparatus.

3. The apparatus according to claim 1 wherein said winch means includes a main winch and an auxiliary winch spaced from the main winch, both of said winches being employed to raise said travel car to the top of the tank, the auxiliary winch being employed to adjust the attitude of said car.

4. The apparatus according to claim 3 wherein said winches are motor driven.

5. The apparatus according to claim 2 wherein said drive means include a motor drivingly connected to one of said wheels.

6. The apparatus according to claim 1 wherein said rigging comprises:

(a) a top section including means for connecting said section to said travel car, (b) a plurality of intermediate sections secured one beneath the other to span substantially the entire height of the tank, the uppermost intermediate section being secured to the top section.

7. The apparatus according to claim 6 wherein said connecting means is located offcenter and inwardly with respect to the centroid of said top section whereby a rotational force is produced about said connecting means tending to maintain said rigging against said tank side.

8. The apparatus according to claim 6 wherein said travel car includes a hook plate and said connecting means is a hook engageable on said plate to suspend said rigging therefrom.

9. A method of moving a blast head over the side of a storage tank comprising the steps of:

(a) securing a wheeled car to the tank top, (b) pulling said car to the top of said tank and positioning said car on the outer periphery thereof, (c) suspending a rigging from said car adjacent the tank side, (d) engaging a frame having a blast head secured thereto on said rigging for vertical movement thereover, (e) raising and lowering said frame from said car to move said blast head over a vertical section of said tank side, (f) repositioning the wheeled car to a new location along the outer periphery thereby moving said blast head to a new vertical section, (g) repeating steps (e) and (f) until the blast head has covered the entire tank side.

10. The method of claim 9 wherein step (c) includes the substep of:

assembling the rigging from sectional pieces as it is raised to the point of suspension on the car.

11. The method according to claim 9 wherein step (c) further includes the step of:

suspending the rigging offcenter and inwardly of its center of gravity to create a rotational force tending to maintain said rigging against the side of the tank.

* * * * *